US010029877B2

(12) United States Patent
Allen, Jr. et al.

(10) Patent No.: US 10,029,877 B2
(45) Date of Patent: Jul. 24, 2018

(54) CONVEYOR SECTION HAVING A FAN FOR DUST REMOVAL

(71) Applicant: A. G. Stacker Inc., Weyers Cave, VA (US)

(72) Inventors: Clarence C. Allen, Jr., Mt. Crawford, VA (US); Kevin G. Gorby, Harrisonburg, VA (US); Micah C. Sundstrom, Staunton, VA (US)

(73) Assignee: A.G. Stacker Inc., Weyers Cave, VA (US)

( * ) Notice: Subject to any disclaimer, the term of this patent is extended or adjusted under 35 U.S.C. 154(b) by 0 days.

(21) Appl. No.: 15/783,679

(22) Filed: Oct. 13, 2017

(65) Prior Publication Data

US 2018/0105382 A1 Apr. 19, 2018

Related U.S. Application Data

(60) Provisional application No. 62/408,633, filed on Oct. 14, 2016.

(51) Int. Cl.

| | |
|---|---|
| ***B65H 29/14*** | (2006.01) |
| ***B65H 31/02*** | (2006.01) |
| ***B65H 37/00*** | (2006.01) |

(52) U.S. Cl.

CPC ..... *B65H 29/14* (2013.01); *B65H 31/02* (2013.01); *B65H 37/00* (2013.01); *B65H 2301/121* (2013.01); *B65H 2406/36625* (2013.01); *B65H 2801/42* (2013.01)

(58) Field of Classification Search

CPC .... B65H 29/12; B65H 29/14; B65H 2406/30; B65H 2406/31; B65H 2515/83; B65H 2601/511; B65H 2801/42; B65H 37/00; B65H 2406/3662; B26D 7/32; B26D 7/0625; B26D 7/088; B26D 7/1863

See application file for complete search history.

(56) References Cited

U.S. PATENT DOCUMENTS 4,204,672 A * 5/1980 Grivet ..... B65H 29/12 271/188
4,241,910 A * 12/1980 Matsuo ..... B65H 29/12 15/77
4,544,824 A * 10/1985 Knutsson ..... A41H 43/0292 219/121.67
5,065,469 A * 11/1991 Takken ..... B08B 7/02 134/32

(Continued)

*Primary Examiner* — David H Bollinger
(74) *Attorney, Agent, or Firm* — J-TEK Law PLLC; Jeffrey D. Tekanic; Scott T. Wakeman

(57) ABSTRACT

A conveying apparatus includes an upper conveyor and a lower conveyor, the top of the lower conveyor facing the bottom of the upper conveyor and defining with the bottom of the upper conveyor a sheet transport path. An air duct having an opening facing the top of the upper conveyor is mounted over the upper conveyor, and a fan is provided that is in fluid communication with the air duct. The fan draws air through the opening, into the air duct and out an exhaust vent. A housing substantially encloses the upper conveyor and the lower conveyor and is connected to the air duct, and the housing has a bottom opening located below the sheet transport path such that a majority of the air drawn through the opening by the fan passes through the upper conveyor.

14 Claims, 7 Drawing Sheets

(56) References Cited

U.S. PATENT DOCUMENTS

| | | | | |
|---|---|---|---|---|
| 5,450,333 | A * | 9/1995 | Minami | B23K 26/0846 700/167 |
| 6,412,379 | B1 * | 7/2002 | Turusaki | B26D 7/18 83/155.1 |
| 2004/0118256 | A1 * | 6/2004 | Prinzen | B26D 7/1863 83/13 |
| 2010/0093508 | A1 * | 4/2010 | Cummings | B26D 5/00 493/366 |
| 2011/0049781 | A1 * | 3/2011 | Lewalski | B26D 7/015 270/58.07 |
| 2012/0053035 | A1 * | 3/2012 | Diehr | B65H 5/023 493/128 |
| 2013/0074457 | A1 * | 3/2013 | Brown | B65B 11/00 53/580 |

* cited by examiner

CONVEYOR SECTION HAVING A FAN FOR DUST REMOVAL

CROSS-REFERENCE TO RELATED APPLICATIONS

The present application claims the benefit of U.S. Provisional Patent Application No. 62/408,633 filed Oct. 14, 2016, the contents of which are hereby incorporated by reference.

TECHNOLOGICAL FIELD

The present disclosure is directed to a conveyor section having a dust removal feature, and, more specifically, toward a conveyor section having upper and lower conveyors and a fan for drawing air through the conveyors to remove dust from a region around the conveyors.

BACKGROUND

Known stacking systems are configured to be used adjacent to a rotary die cut machine which cuts blanks (not illustrated) from sheets of material, for example, corrugated paperboard. The stacking system includes a receiving or "layboy" section that receives the sheets from the die cut machine and discharges them onto a transfer conveyor. The transfer conveyor carries the sheets to an inclined main conveyor, and the sheets travel along the main conveyor to its downstream end where they are discharged into a accumulator.

Die cut machines produce a certain amount of scrap material and dust during operation which scrap consists mainly of the portions of the input material that do not become part of a finished sheet. In addition, each sheet may include slots or through-openings. The material cut from the sheets to form these slots and through-openings also constitutes scrap.

Most scrap material produced by the die cut machine drops beneath or immediately in front of the die cut machine as it operates. However, it is not uncommon for a sheet to be cut incompletely so that portions of the sheet that were supposed to be removed instead travel into the layboy with the sheet. Excessive scrap in the transport path between the layboy section and the final stack of sheets may adversely affect the transport of the sheets. That is, the scrap may interfere with the alignment of the sheets or lead to jams. Alternately, if the scrap is carried all the way through the stacker and into the final stack of sheets, the sheets in the stack will have gaps therebetween where the scrap material is present thus resulting in a crooked, or oversized or non-uniform stack of sheets. Some scrap may even end up inside a finished box formed from the cut sheets; this is generally undesirable to most end customers and must be completely avoided in some applications, such as boxes for use to package food.

It is therefore known to provide various scrap removal devices in a stacking system. These may comprise, for example, brushes that gently contact a top and/or bottom surface of the moving sheets to dislodge the scrap and/or air jets directed against the sheets. In addition, dust can be created by the die cut process, and dust can be stirred up by the brushes and other elements intended to remove scrap from the sheets of material as they are moved along a conveyor system. It would be desirable to reduce the amount of dust present in a final stack of sheets as well as to reduce the amount of dust that enters the environment surrounding the stacking system.

SUMMARY

It may sometimes be desirable to add an additional conveyor section to a stacking system, between the layboy section 14 and the transfer conveyor 16 or between the transfer conveyor 16 and the main conveyor 18, for example. This additional section may be, for example, a section configured to divert selected sheets from a stream of sheets as described in co-pending application Ser. No. 15/783,630 filed concurrently herewith, entitled "Diverter Conveyor," and assigned to the assignee of the present application, which application is hereby incorporated by reference. Instead of or in addition to such functions, this additional conveyor section may be configured to remove dust from sheets of material and/or from the air surrounding the sheets of material to potentially produce a cleaner stack of sheets and to improve the quality of air in the environment of the stacking system by removing dust therefrom.

A first aspect of the disclosure therefore comprises a conveying apparatus that includes an upper conveyor having a top and a bottom and a lower conveyor having a top and a bottom, the top of the lower conveyor facing the bottom of the upper conveyor and defining with the bottom of the upper conveyor a sheet transport path from an upstream end of the conveying apparatus to a downstream end of the conveying apparatus. The apparatus also includes an air duct having an opening facing the top of the upper conveyor and a fan in fluid communication with the air duct. The fan is configured to draw air through the opening into the air duct and out an exhaust vent. A housing substantially encloses the upper conveyor and the lower conveyor and is connected to the air duct. The housing has a bottom opening located below the sheet transport path such that a majority of the air drawn through the opening by the fan passes through the upper conveyor.

Another aspect of the disclosure comprises a conveying apparatus configured to transport sheets along a transport path in a first direction from an input end to a discharge end. The conveying apparatus comprises a first conveyor having an upstream end, a downstream end, and a first side and a second side extending from the upstream end to the downstream end. The first conveyor includes a first plurality of contact elements. The conveying apparatus also includes a second conveyor having an upstream end, a downstream end, and a first side and a second side extending from the upstream end of the second conveyor to the downstream end of the second conveyor. The second conveyor includes a second plurality of contact elements, the second plurality of contact elements facing the first plurality of contact elements and defining with the first plurality of contact elements a sheet transport path between the first conveyor and the second conveyor. The apparatus also includes an air duct having an opening spaced from and facing the first conveyor and a fan in fluid communication with the air duct, the fan being configured to draw air through the opening into the air duct and discharge the air out an exhaust vent.

A further aspect of the disclosure comprises a conveying apparatus configured to transport sheets along a transport path in a first direction from an input end to a discharge end. The conveying apparatus includes a frame having a first side and a second side and a front end and a rear end. An upper conveyor is mounted in the frame and has an upstream end at the frame front end, a downstream end at the frame rear end, and a first side and a second side extending from the upstream end to the downstream end. The first conveyor comprises a plurality of belts, each belt of the plurality of belts having a first end located in a middle of the upper conveyor and a second end. The second ends of a first set of the plurality of belts are located at the upstream end of the upper conveyor, and the second ends of a second set of the plurality of belts are located at the downstream end of the upper conveyor. The apparatus also includes a lower conveyor mounted in the frame and having an upstream end at the frame front end, a downstream end at the frame rear end, and a first side and a second side extending from the upstream end of the second conveyor to the downstream end of the second conveyor. The second conveyor comprises a plurality of wheels supported on a plurality of rods extending from the first side of the frame to the second side of the frame, and the plurality of wheels is spaced from the plurality of belts to define a sheet transport path between the upper conveyor and the lower conveyor. The apparatus also includes an air duct mounted on the frame above the upper conveyor, the air duct having an opening above the upper conveyor, and a housing supported by the frame. The housing substantially encloses the upper conveyor and the lower conveyor and is connected to the air duct. A fan is in fluid communication with the air duct and is configured to draw air through the opening into the air duct and to discharge the air out an exhaust vent.

DETAILED DESCRIPTION

Figure 1:
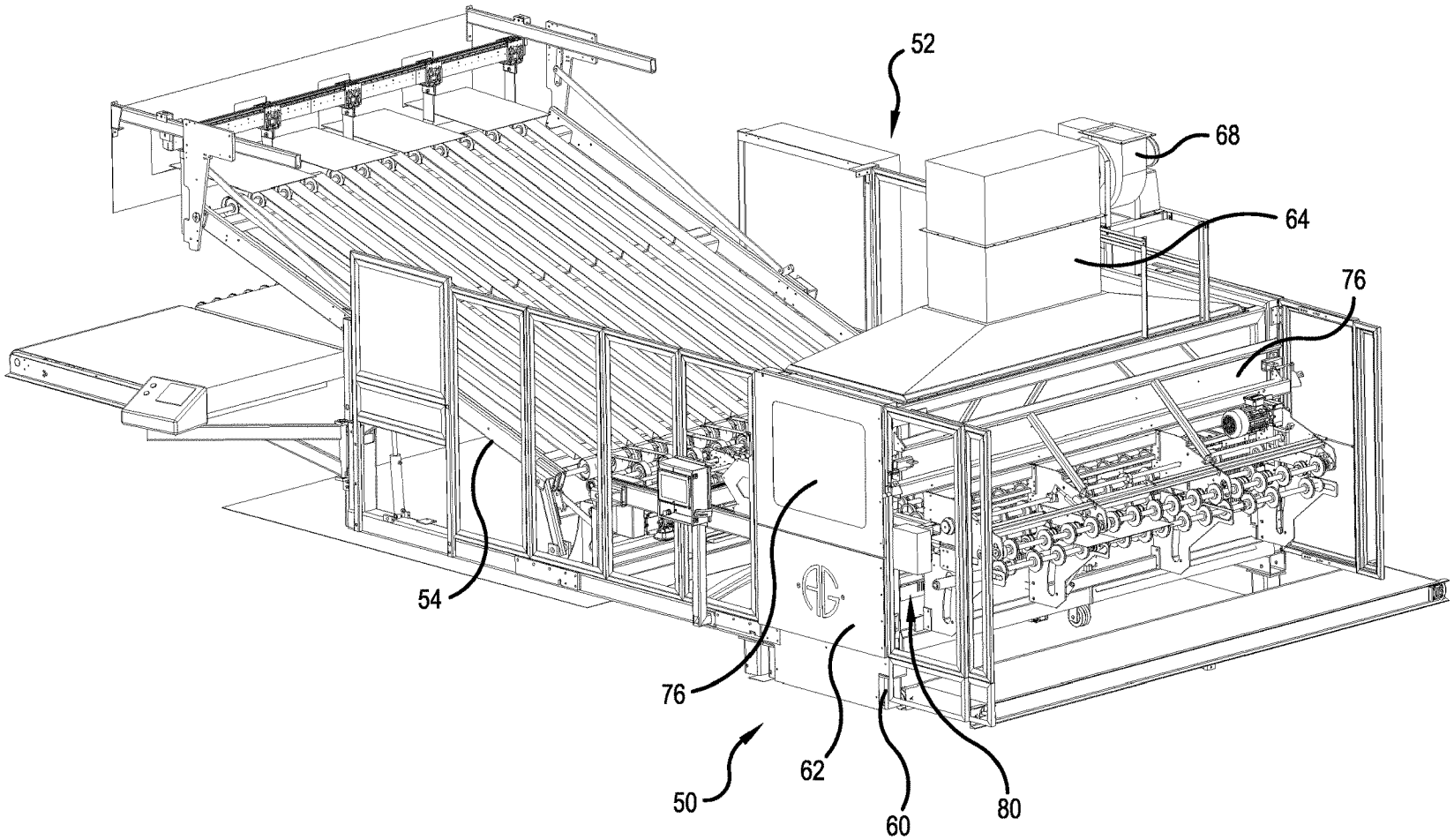
FIG. 1 is a perspective view of a conveyor section having upper and lower conveyors and an air duct and a fan according to the present disclosure mounted at the intake end of a main conveyor of a sheet stacking system.
Figure 3:
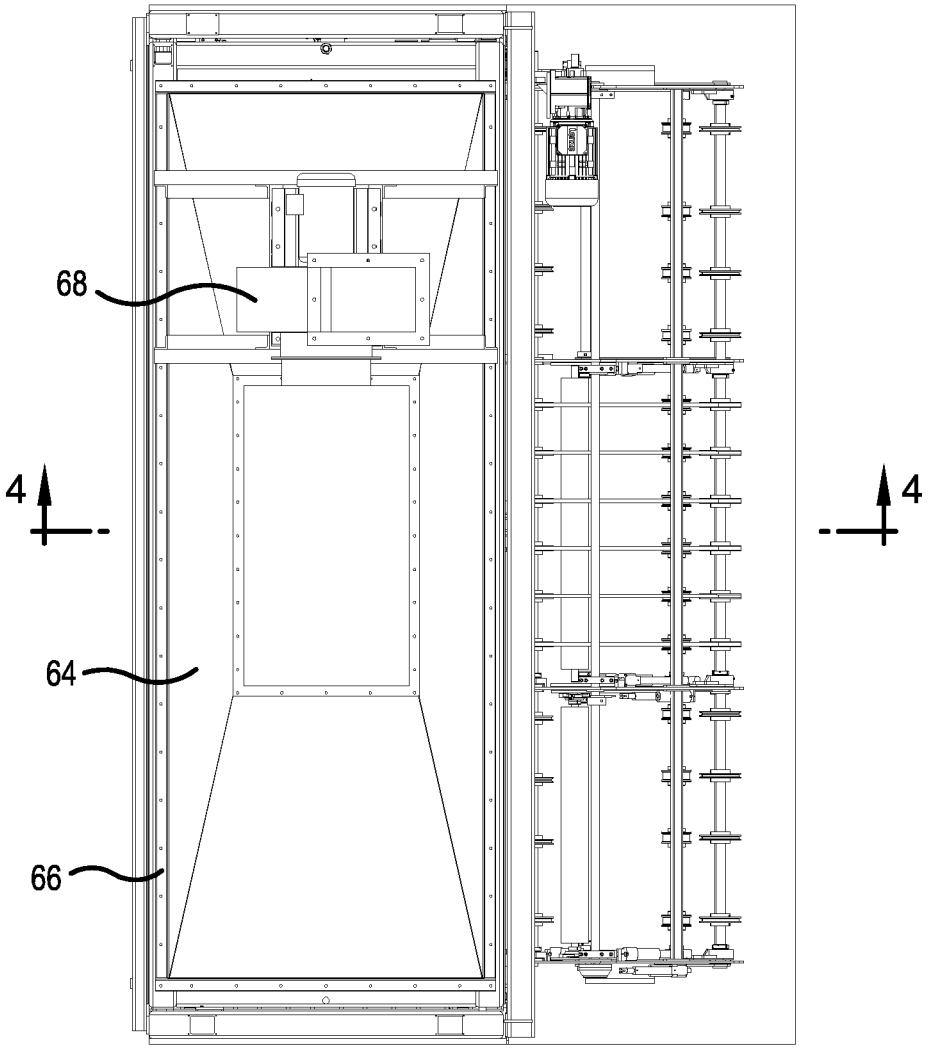
FIG. 3 is bottom plan view of the air duct of FIG. 2.
Figure 4:
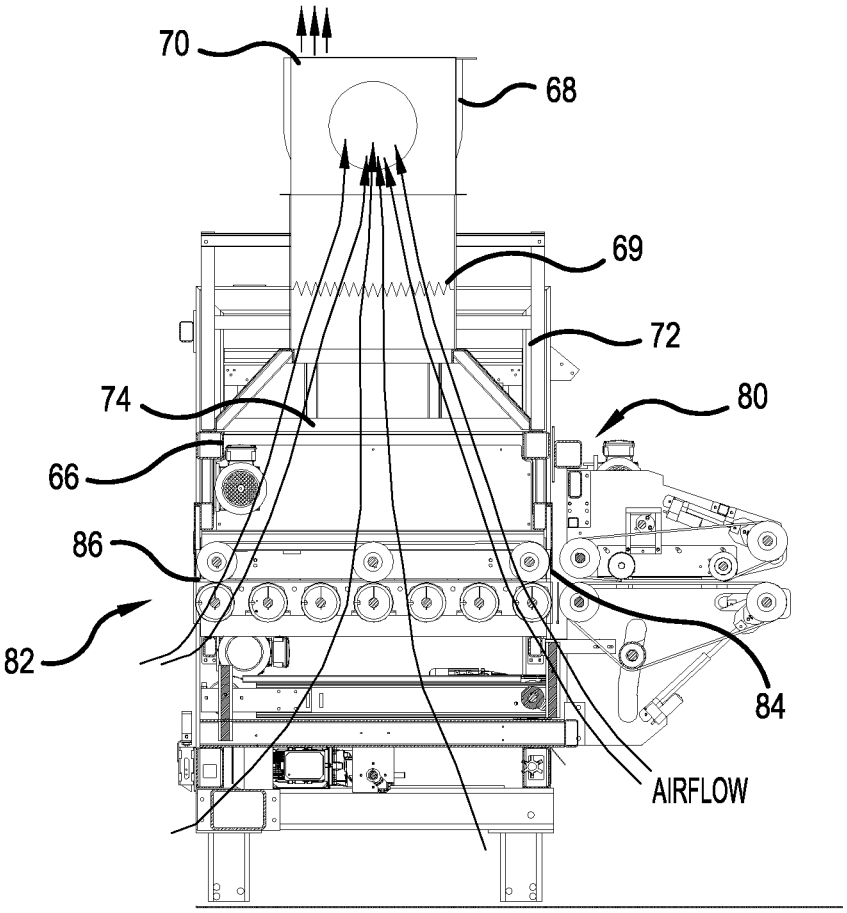
FIG. 4 is a sectional side elevational view of the conveyor section of FIG. 1.
Figure 5:
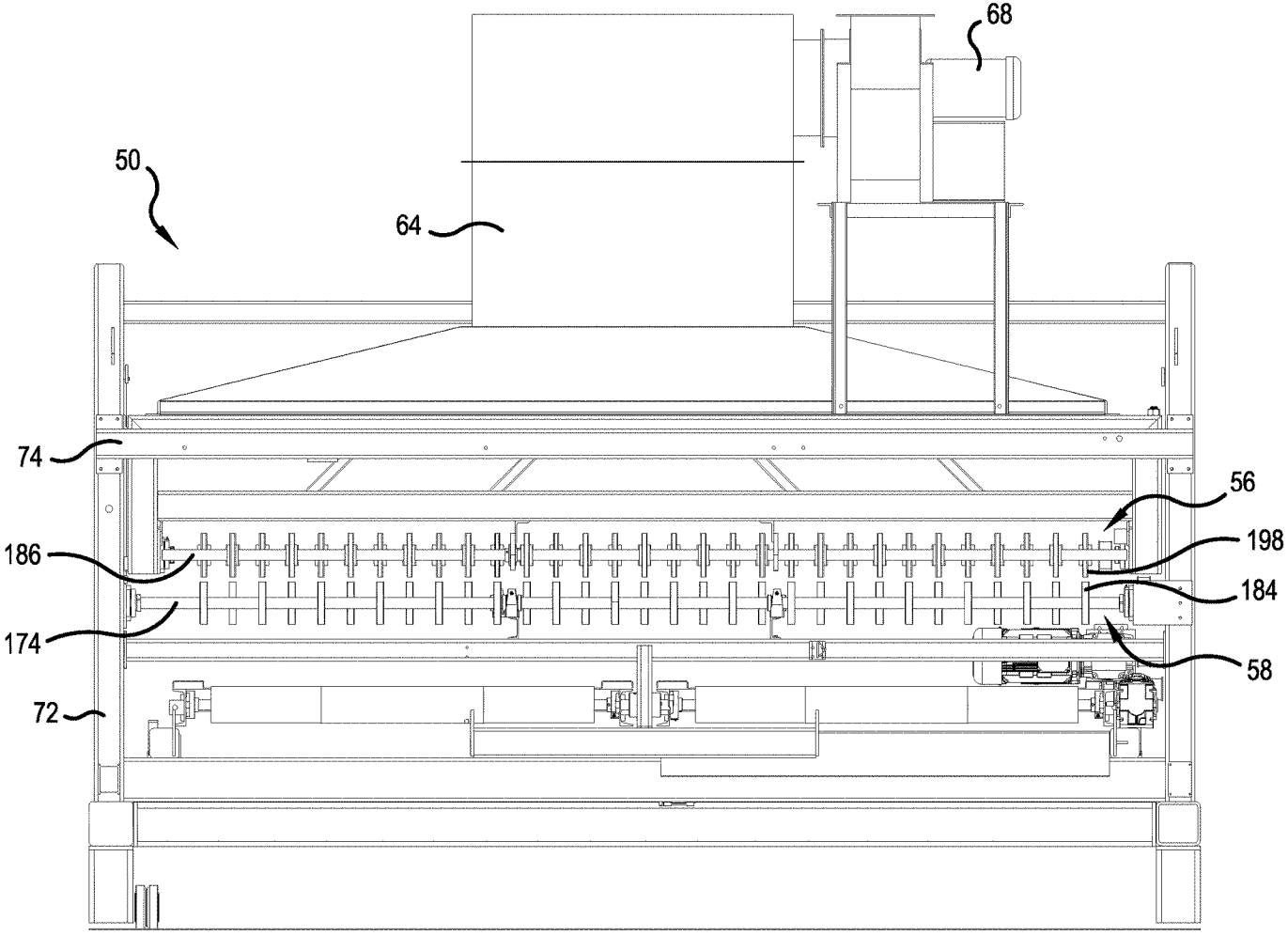
FIG. 5 is a front elevational view of the conveyor section of FIG. 1 looking in the direction of sheet transport.

Referring now to the drawings, wherein the showings are for the purpose of illustrating embodiments of the disclosure only and not for the purpose of limiting same, FIG. 1 shows a conveyor section 50 according to the present disclosure mounted at the intake end 52 of a conventional stacking conveyor 54. The conveyor section 50 includes an upper conveyor 56 and a lower conveyor 58 supported by a frame 60, as best seen in FIG. 5, and the upper and lower conveyors 56, 58 are substantially enclosed by a housing 62 mounted on the frame 60. In addition, an air duct 64 is mounted on the top of the frame 60 and includes an opening 66 (FIG. 3) spaced from and facing the top surface of the upper conveyor 56. A fan 68 is connected to the air duct 64 and is configured to draw air through the opening 66 and an optional air filter 69, a HEPA filter, for example, and out an exhaust opening 70. With this arrangement, dust present on sheets passing through the conveyor section 50 and/or dust stirred up by a scrap removal process carried out in the conveyor section 50 will be drawn through the opening 66 and the optional filter 69 and discharged from the exhaust opening 70.

Figure 2:
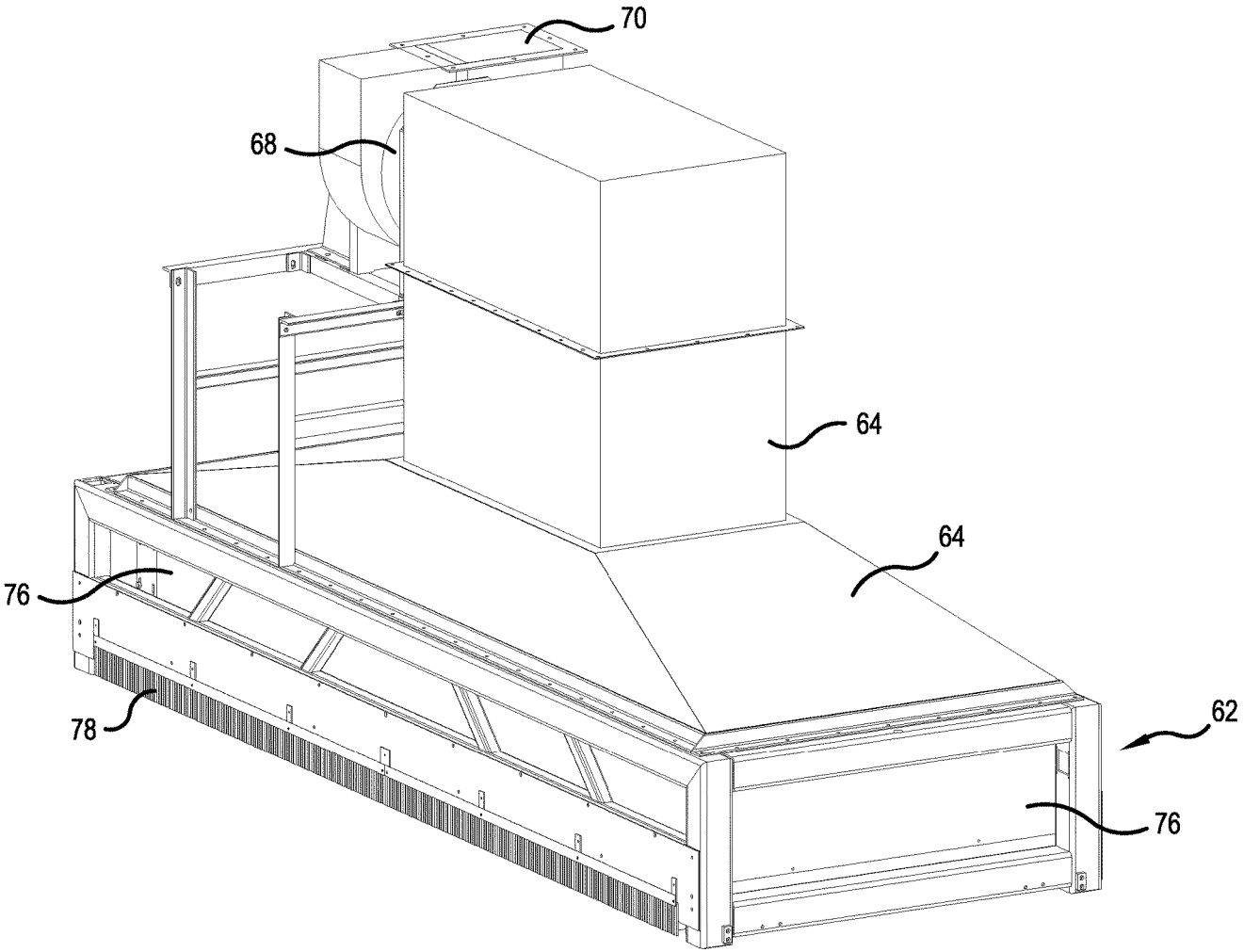
FIG. 2 is a perspective view of the air duct and fan of the conveyor section of FIG. 1.

The frame 60 includes vertical support members 72 and horizontal support members 74 and a plurality of panels 76 mounted between the vertical and horizontal support members 72, 74 to enclose the area around the upper conveyor 56 and the lower conveyor 58. In general, the housing 62 extends from the air duct 64 to a position below the bottom of the lower conveyor 58 so that substantially all the air drawn into the air duct 64 by the fan 68 will first pass through both the lower conveyor 58 and the upper conveyor 56 and past any sheets of material present in the transport path. This flow of air serves both to remove dust loosely attached to the sheets of material and to remove dust in the vicinity of the transport path that is stirred up by scrap removal devices such as the brush 78 illustrated in FIG. 2.

The conveyor section 50 includes an upstream end 80 and a downstream end 82, and the sheets travel along the transport path in the downstream direction from the upstream end 80 to the downstream end 82. The housing 60 includes an opening 84 aligned with a nip at the upstream end 80 of the upper conveyor 56 and an opening 86 aligned with the nip at the downstream end 82 of the upper conveyor 56 so that sheets can move smoothly from an upstream conveyor (not illustrated) through the conveyor section 50 and out to a downstream conveyor such as the main conveyor deck of the stacking conveyor 54 shown in FIG. 1. These openings 84, 86 are slightly wider than the transport path of the conveyor section 50 and slightly taller than the vertical thickness of the thickest sheet expected to be processed. Alternately, sliding plates (not illustrated) can be provided at either the first or second opening 84, 86 to partially cover the openings 84, 86 to adjust the vertical heights of the openings 84, 86. Some of the air drawn into the housing 60 by the fan 68 will pass through the upstream opening 84 and the downstream opening 86 and will not pass through the lower conveyor 58. However, even the air that is drawn through the openings 84, 86 will pass along the transport path and may help dislodge dust from the sheets in the transport path. Because the bottom portion of the frame 60 does not include panels 76, a larger air flow path is provided at the bottom of the frame 60 than through the openings 84, 86 and therefore the majority of the air drawn into the housing 62 will enter the housing 62 from the bottom and will pass through both the lower conveyor 58 and the upper conveyor 56.

The dust removal system can be used with a variety of upper and lower conveyors. However, a configuration of upper and lower conveyors that is particularly useful with the above-described dust removal system is described below and illustrated in FIGS. 5-7.

Figure 6:
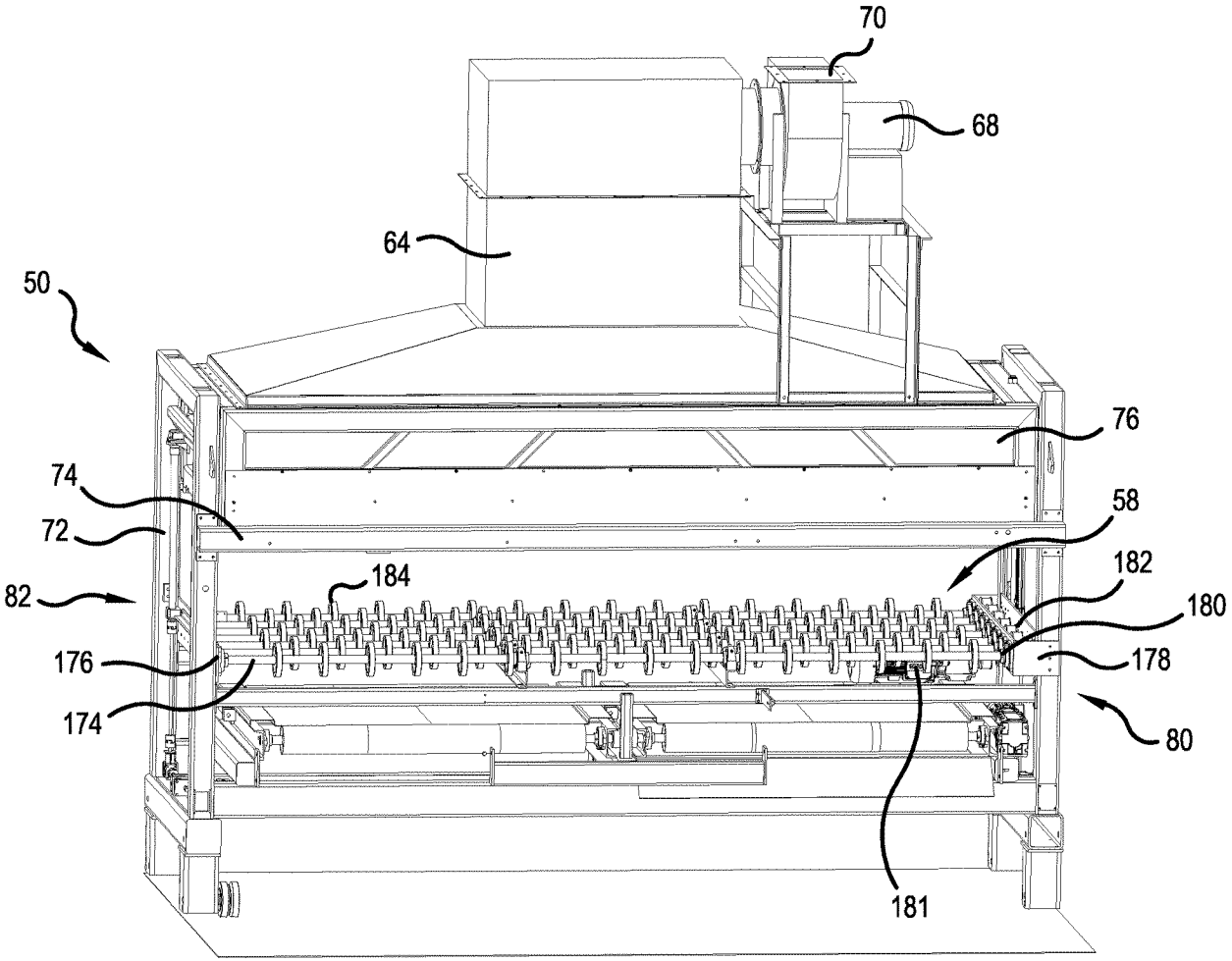
FIG. 6 is a perspective view of the conveyor section of FIG. 1 with the upper conveyor removed for clarity.

In FIG. 6, the upper conveyor 56 has been removed for illustration purposes so that the lower conveyor 58 can more easily be seen. The lower conveyor 58 includes a plurality of transverse support shafts 174 that are rotatably mounted in a first support 176 at the left side of the conveyor section 50 and in a second support 178 at the right side of the conveyor section 50. End portions 180 of the support shafts 174 are operably connected to a drive 181 and interconnected by suitable drive belts or drive chains 182 so that all the support shafts 714 rotate in unison. The drive belts or drive chains 182 are located inside the second support 178 and do not contact sheets during sheet transport.

Each of the support shafts 174 includes a plurality of wheels 184. The wheels 184 are fixed against rotation relative to the support shafts 174 and therefore rotate with the support shafts 174. The wheels 184 may be discrete elements that are selectably securable to the support shafts 174, using screws or clamps (not illustrated) so that the number and location of the wheels 184 on the shafts 174 can be adjusted. Alternately, the wheels 184 may be integrally formed with the shafts 174 and thus comprise portions of the shafts 174 that have greater diameters. In other words, each shaft 174 may comprise first portions having a small diameter and second portions having a large diameter, the large diameter portions forming the wheels 184.

The wheels 184 on each of the shafts 174 are evenly spaced in a transverse direction, that is, a direction transverse to the sheet travel direction. However, counting the shafts from front to back in the view of FIG. 6 with the front-most shaft 174 being the first shaft 174, the wheels 184 on the odd numbered shafts are offset in the third direction from the wheels 184 on the even-numbered shafts. The wheels on all the odd-numbered shafts 174 are mutually aligned in the sheet travel direction, and the wheels on the even-numbered shafts are mutually aligned in the sheet travel direction. However, when viewed from the left side of the conveyor section 50, the wheels 184 of the even number shafts 174 overlap the wheels 184 of the odd numbered shafts 174 in the second direction. In other words, the diameter of each of the wheels 184 is greater than the distance between each pair of shafts 174 in the sheet travel direction. Staggering the wheels 184 in this manner helps provide a suitable support surface for sheets being transported. The shafts 174 are mounted such that the tops of the wheels 184 lie substantially in a single plane and such that a sheet resting on the wheels 184 will be substantially horizontal and planar.

The wheels 184 are intended to make contact with sheets being transported, and the wheels 184 may therefore sometimes be referred to as "contact elements." The radially outer surfaces of the wheels 184 may be referred to as "contact surfaces" because they are intended to directly contact sheets being transported through the conveyor section 50. These outer surfaces may be knurled to increase friction between the wheels 184 and the sheets. The portions of the wheels 184 facing in the direction of the upper conveyor 56, which portions will directly contact sheets, are described as being located in "contact regions." These contract regions of the wheels 184 are the regions of essentially line-contact between the sheets and the wheels 184 (because the sheets are not perfectly rigid, the area of contact is likely to be a small angular portion of the wheels 184 rather than a line). The contact regions therefore lie in a plane or are bounded by a plane, the plane representing the plane of a hypothetical perfectly rigid sheet resting on the surfaces of the wheels 184. Therefore, as the wheels 184 rotate, a given point on the surface of each wheel 184 will rotate into and out of the contact region.

Figure 7:
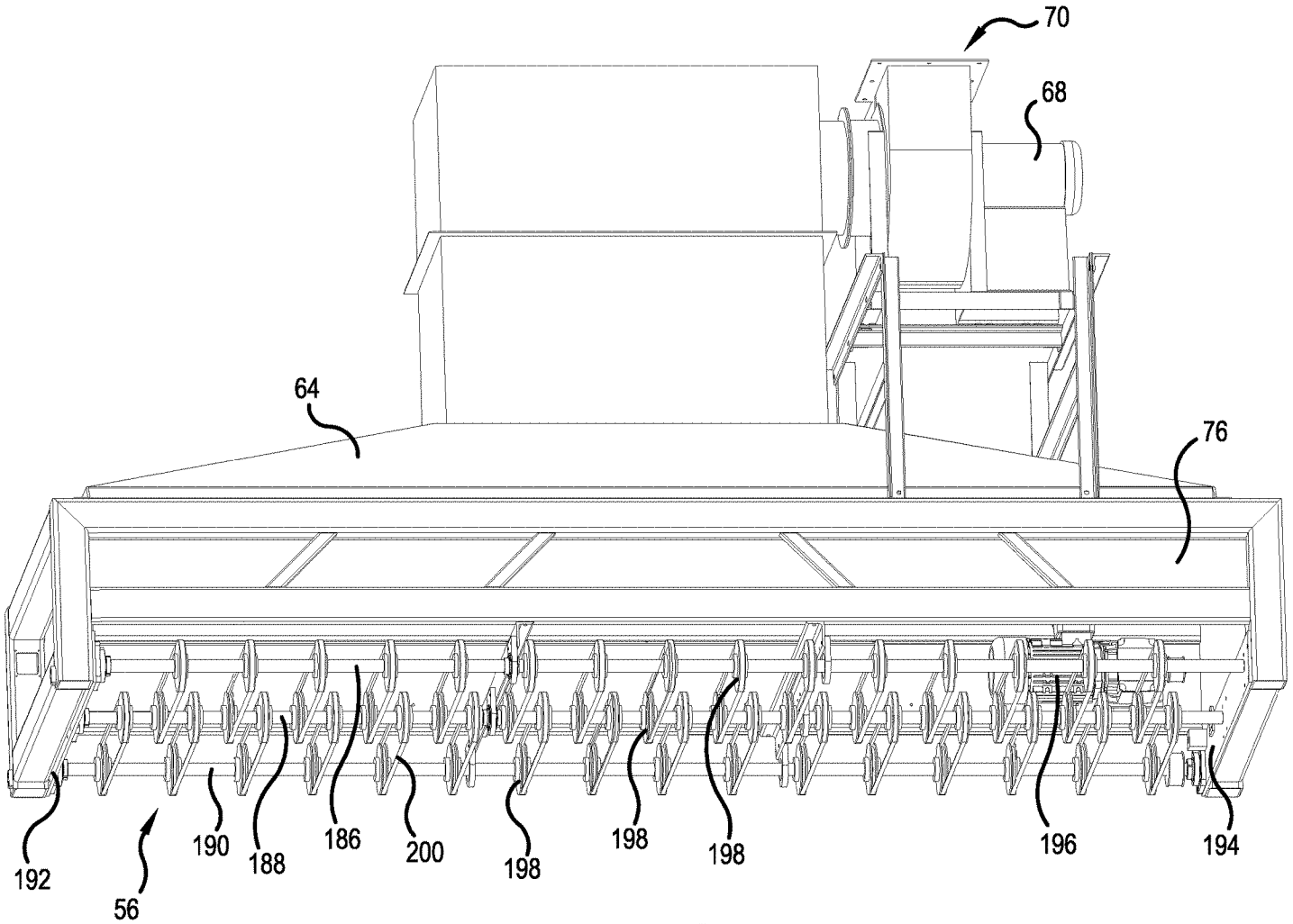
FIG. 7 is a perspective view of the upper conveyor and air duct of the conveyor section of FIG. 1.

Referring now to FIG. 7, the upper conveyor 56 includes a front transverse shaft 186, a middle transverse shaft 188 and a rear transverse shaft 190 which transverse shafts 186, 188, 190 extend from left to right from a first support 192 at the left side of the upper conveyor 56 to a second support 194 at the right side of the upper conveyor 56. The middle transverse shaft 188 is operably connected to a drive 196.

A plurality of pulleys 198 are mounted on the middle transverse shaft 188 and attached to the middle shaft 188 so that they rotate with the shaft when the shaft 188 is driven. The pulleys 198 are evenly spaced along the middle shaft 188 and may be described as being located at numbered locations 1, 2, 3 . . . 31 along the middle shaft 188. The front shaft 186 also includes a plurality of pulleys 198 that are fixed to the front shaft 186 for rotation therewith. The number of pulleys 198 on the front shaft 186 is approximately one half the number of the pulleys 198 on the middle shaft 188, and the pulleys 198 on the front shaft 186 are aligned with every other one of the pulleys 198 on the middle shaft 188. In FIG. 7, the pulleys 198 on the front shaft 186 are aligned with the even-numbered pulleys 198 on the middle shaft 188. The rear shaft 190 also includes a plurality of the pulleys 198 fixed to the rear shaft 90 for rotation therewith. The pulleys 198 on the rear shaft 90 are aligned with the odd-numbered pulleys 198 of the middle shaft 188. Belts 200 connect aligned pairs of pulleys 198 on the front shaft 186 and the middle shaft 188 and aligned pairs of the pulleys 198 on the middle shaft 188 and the rear shaft 190. Because the middle shaft 188 is driven by the drive 196 and the middle shaft 188 is connected to the front shaft 186 and to the rear shaft 190 by the belts 200, the front shaft 186 and the rear shaft 190 are driven by the rotation of the middle shaft 188.

The belts 200 of the upper conveyor 56 are examples of sheet contact elements that are configured to make direct contact with sheets traversing the conveyor section 50. The portions of the belts 200 that face the lower conveyor 58 form sheet contact surfaces. These sheet contact surfaces lie substantially in a plane parallel to the sheet transport direction. The portions of the belts 200 that face the lower conveyor 58 are located in a contact region, and all points on the belts 200 travel from contact regions (facing the lower conveyor 58) to non-contact regions (facing away from the lower conveyor 58) as the belts 200 rotate.

In operation, the upper conveyor 56 is positioned relative to the lower conveyor 58 so that the vertical separation between the plane in which the tops of the wheels 184 lie and the plane in which the bottoms of the belts 200 lie are separated by a desired distance based on the thickness of the sheets to be transported. In order to allow adequate control of the movement of the sheets without crushing or damaging the sheets during transport, the vertical separation will be approximately equal to the thickness of the sheets being transported. The sheets will exit an upstream conveyor (not illustrated) and enter a nip at the upstream end 80 of the conveyor section 50 through the opening 84, which nip is defined by the belts 200 of the upper conveyor section 56 and the wheels 184 of the lower conveyor section 58. The lower conveyor drive 181 and the upper conveyor drive 196 are coordinated so that the belts 200 travel at the same speed as the tops of the wheels 184, and this pulls the sheets along the conveyor section 50 from the upstream end 80 to the downstream end 82 and ejects the sheets to a downstream conveyor such as the main conveyor 54 of a stacking system as illustrated in FIG. 1.

In many cases, belts provide a greater degree of control over the movement of sheets in a conveyor because a relatively large surface area of the belts remains in contact with the sheets as they move along a conveyor section. At the same time, this greater area of contact may hold scrap against the sheets and prevent the scrap from being removed from the sheets before they are stacked. The inventors have found that using wheels 184 on the lower conveyor 58 makes it easier for scrap to fall from the sheets and out of the sheet transport path (onto the scrap removal conveyors 164, for example) than if belts were used on both the upper and lower conveyors. That is, all lower surfaces of the sheets are free from roller or wheel contact at some time as the sheets traverse the conveyor section 50. This also helps prevent dust from being trapped against the sheets. At the same time, the use of belts 200 on the upper conveyor 56 provides adequate control over the movement of the sheets. And, because the belts 200 are staggered such that no individual belt 200 extends all the way from the upstream end 80 to the downstream end 82 of the conveyor section 50, all upper surfaces of the sheets are free from belt contact at some point as they traverse the conveyor section 50. This arrangement, when used with brushes, blowers, vacuums or other devices for removing scrap from sheets, has been found to improve the scrap removal process.

The present invention has been described herein in terms of a preferred embodiment. Additions and modifications to this embodiment will become apparent to persons of ordinary skill in the art upon a reading of the foregoing description. It is intended that all such modifications and additions form a part of the present invention to the extent they fall within the scope of the several claims appended hereto.

What is claimed is:

1. A conveying apparatus comprising:

an upper conveyor having a top and a bottom; and a lower conveyor having a top and a bottom, the top of the lower conveyor facing the bottom of the upper conveyor and defining with the bottom of the upper conveyor a sheet transport path from an upstream end of the conveying apparatus to a downstream end of the conveying apparatus;

an air duct having an opening facing the top of the upper conveyor;

a fan in fluid communication with the air duct, the fan being configured to draw air through the opening, into the air duct and out an exhaust vent; and a housing substantially enclosing the upper conveyor and the lower conveyor and connected to the air duct, the housing having a bottom opening located below the sheet transport path such that a majority of the air drawn through the opening by the fan passes through the upper conveyor.

2. The conveying apparatus according to claim 1, wherein the bottom opening of the housing is located below the lower conveyor such that the majority of the air drawn through the opening by the fan first passes through the lower conveyor and the upper conveyor.

3. A conveying apparatus configured to transport sheets along a transport path in a first direction from an input end to a discharge end, the conveying apparatus comprising:

a first conveyor having an upstream end, a downstream end, and a first side and a second side extending from the upstream end to the downstream end, the first conveyor comprising a first plurality of contact elements, a second conveyor having an upstream end, a downstream end, and a first side and a second side extending from the upstream end of the second conveyor to the downstream end of the second conveyor, the second conveyor comprising a second plurality of contact elements, the second plurality of contact elements facing the first plurality of contact elements and defining with the first plurality of contact elements a sheet transport path between the first conveyor and the second conveyor, an air duct having an opening spaced from and facing the first conveyor; and a fan in fluid communication with the air duct, the fan being configured to draw air through the opening into the air duct and discharge the air out an exhaust vent.

4. The conveying apparatus according to claim 3, wherein the first plurality of contact elements are belts and the second plurality of contact elements are wheels.

5. The conveying apparatus according to claim 4, wherein the first conveyor is located above the second conveyor.

6. The conveying apparatus according to claim 4, wherein the sheet transport path is substantially horizontal and the air duct opening faces in a downward vertical direction.

7. The conveying apparatus according to claim 3, wherein the sheet transport path lies in a first plane and the air duct opening lies in a second plane substantially parallel to the first plane.

8. The conveying apparatus according to claim 3, wherein the sheet transport path lies in a plane and the air duct is positioned to draw air through the sheet transport path in a direction perpendicular to the plane.

9. The conveying apparatus according to claim 3, including a housing substantially enclosing the first conveyor and the second conveyor, the housing including a first opening at the upstream end of the sheet transport path positioned such that sheets can enter the sheet transport path through the first opening and a second opening at the downstream end of the sheet transport path positioned such that sheets can exit the sheet transport path through the second opening, the housing being connected to the air duct.

10. The conveying apparatus according to claim 9, wherein the conveyor includes a frame, wherein the first conveyor and the second conveyor are supported by the frame, wherein the air duct is mounted on the frame and at least partially supported by the frame, and wherein the housing is mounted on the frame.

11. The conveying apparatus according to claim 3, including a housing substantially enclosing the first conveyor and connected to the air duct, the housing being positioned such that substantially all air drawn through the opening by the fan passes through the first conveyor.

12. The conveying apparatus according to claim 3, including an air filter in the air duct.

13. The conveying apparatus according to claim 3, wherein the conveyor includes a frame, wherein the first conveyor and the second conveyor are supported by the frame, and wherein the air duct is mounted on the frame and at least partially supported by the frame.

14. A conveying apparatus configured to transport sheets along a transport path in a first direction from an input end to a discharge end, the conveying apparatus comprising:

a frame having a first side and a second side and a front end and a rear end;

an upper conveyor mounted in the frame and having an upstream end at the frame front end, a downstream end at the frame rear end, and a first side and a second side extending from the upstream end to the downstream end, the first conveyor comprising a plurality of belts, each belt of the plurality of belts having a first end located in a middle of the upper conveyor and a second end, the second ends of a first set of the plurality of belts being located at the upstream end of the upper conveyor and the second ends of a second set of the plurality of belts being located at the downstream end of the upper conveyor;

a lower conveyor mounted in the frame and having an upstream end at the frame front end, a downstream end at the frame rear end, and a first side and a second side extending from the upstream end of the second conveyor to the downstream end of the second conveyor, the second conveyor comprising a plurality of wheels supported on a plurality of rods extending from the first side of the frame to the second side of the frame, the plurality of wheels being spaced from the plurality of belts to define a sheet transport path between the upper conveyor and the lower conveyor, an air duct mounted on the frame above the upper conveyor, the air duct having an opening above the upper conveyor;

a housing supported by the frame, the housing substantially enclosing the upper conveyor and the lower conveyor and being connected to the air duct; and a fan in fluid communication with the air duct, the fan being configured to draw air through the opening into the air duct and discharge the air out an exhaust vent.

* * * * *